US008926207B2

(12) United States Patent
Chevalier et al.

(10) Patent No.: US 8,926,207 B2
(45) Date of Patent: Jan. 6, 2015

(54) WRINGER FOR PRODUCT APPLICATOR, APPLICATION ASSEMBLY COMPRISING SUCH A WRINGER, AND ITS USE IN COSMETICS

(75) Inventors: Marc Chevalier, Franconville (FR); Jean-Francois Tranchant, Marigny-les-Usages (FR); Myriam Chevalier, Boigny-sur-Bionne (FR)

(73) Assignee: LVMH Recherche, Saint Jean de Braye (FR)

( * ) Notice: Subject to any disclaimer, the term of this patent is extended or adjusted under 35 U.S.C. 154(b) by 628 days.

(21) Appl. No.: 13/209,526

(22) Filed: Aug. 15, 2011

(65) Prior Publication Data

US 2012/0048824 A1 Mar. 1, 2012

(30) Foreign Application Priority Data

Aug. 27, 2010 (FR) ..... 10 56828

(51) Int. Cl.
*A46B 11/00* (2006.01)
*A45D 40/26* (2006.01)
*A45D 34/04* (2006.01)

(52) U.S. Cl.
CPC ..... *A45D 40/267* (2013.01); *A45D 34/046* (2013.01)
USPC ..... 401/129; 401/122

(58) Field of Classification Search
CPC . A45D 40/265; A45D 40/267; A45D 40/268; G01F 23/04; G01F 23/045; A47L 21/00; A47L 21/04; A47L 210/06
USPC ..... 401/121, 122, 126, 128–130; 33/722, 33/725; 15/218.1
See application file for complete search history.

(56) References Cited

U.S. PATENT DOCUMENTS

| | | | | |
|---|---|---|---|---|
| 3,957,066 | A | 5/1976 | Dahm | |
| 4,241,743 | A | 12/1980 | Schnabel et al. | |
| 4,390,298 | A | 6/1983 | Carluccio | |
| 4,407,311 | A * | 10/1983 | Gueret | 401/122 |
| 4,609,300 | A * | 9/1986 | Robert | 401/122 |
| 5,099,584 | A * | 3/1992 | Williams | 33/725 |
| 5,697,720 | A * | 12/1997 | Lhuisset | 401/122 |
| 6,010,265 | A * | 1/2000 | Bouix | 401/122 |
| 6,033,142 | A | 3/2000 | Gueret | |

(Continued)

FOREIGN PATENT DOCUMENTS

| | | |
|---|---|---|
| DE | 19744181 A1 | 4/1999 |
| EP | 0 991 338 B1 | 6/2004 |

(Continued)

OTHER PUBLICATIONS

French Search Report and Written Opinion from priority French application No. FR 10 56828; Report dated Jun. 14, 2010.

*Primary Examiner* — David Walczak
(74) *Attorney, Agent, or Firm* — Miller, Matthias & Hull LLP

(57) ABSTRACT

A wringer comprising an upper section having a first inner diameter, a lower section having a second inner diameter which is less than the first inner diameter, and an intermediate section which forms a single inwardly projecting annular crease delimiting a central throat having a third inner diameter which in the rest position is at least equal to the second inner diameter. The annular crease is deformable by compression between the upper and lower sections into a wringing position in which the central throat is narrowed.

12 Claims, 7 Drawing Sheets

(56) References Cited

U.S. PATENT DOCUMENTS

| | | | | |
|---|---|---|---|---|
| 6,375,374 | B2 * | 4/2002 | Gueret | 401/122 |
| 7,182,535 | B2 | 2/2007 | Lim | |
| 2010/0104348 | A1 | 4/2010 | Rauschert et al. | |

FOREIGN PATENT DOCUMENTS

| | | | |
|---|---|---|---|
| FR | 2545008 | A1 | 11/1984 |
| FR | 2679425 | A1 | 1/1993 |
| JP | 2004187878 | A | 7/2004 |

* cited by examiner

WRINGER FOR PRODUCT APPLICATOR, APPLICATION ASSEMBLY COMPRISING SUCH A WRINGER, AND ITS USE IN COSMETICS

CROSS-REFERENCE TO RELATED APPLICATIONS

This application claims priority under the Paris Convention to the French Patent Application No. 10 56828, filed on Aug. 27, 2010.

FIELD OF THE DISCLOSURE

The invention relates to wringers for product applicators and particularly for cosmetic product applicators, to application assemblies comprising such wringers, and to their use in cosmetics, particularly for applying eyelash makeup.

BACKGROUND OF THE DISCLOSURE

More particularly, the invention relates to a wringer in the form of an annular sleeve which comprises:

- an upper section designed to be secured by interlocking into the neck of a reservoir of product (liquid or paste), said upper section having a first inscribed circle diameter,
- a free lower section having a second inscribed circle diameter that is less than the first inscribed circle diameter,
- an intermediate section which forms an inwardly projecting annular crease delimiting a central throat having a third inscribed circle diameter which is at least equal to the second inscribed circle diameter in the rest position, and said annular crease being deformable, by axial compression between the upper and lower sections, to a wringing position in which the central throat is smaller than in the rest position, said central throat having in said wringing position a fourth inscribed circle diameter which is less than the second and third inscribed circle diameters.

Document JP-U-60 14351 describes an example of a wringer of this type, intended for a mascara container assembly, which comprises several annular creases and has the disadvantage that the inside of the annular creases rapidly fills with mascara, which deposits there and then prevents said creases from deforming. The wringer becomes clogged by the deposited mascara, interfering with its operation.

In general, in fluid product packaging assemblies having a wringing means, this clogging phenomenon due to deposited product also occurs in the neck, because generally the upper portion of the wringer squeezes the applicator head relatively significantly when said applicator head is reintroduced into the reservoir, leaving deposited product at the neck of the reservoir. This other route to clogging the neck and the upper portion of the wringer is particularly detrimental to the product life, because eventually there is no longer a proper seal at the neck and the product quality is substantially degraded. It can also make it difficult to open the cap.

SUMMARY OF THE DISCLOSURE

The aim of the invention is to overcome these disadvantages.

In the invention, a wringer of the type in question has a single annular crease, and the third inscribed circle diameter is greater than the second inscribed circle diameter.

In this document, the term "inscribed circle diameter" means the diameter of a circle inscribed within the inside surface of a wall delimiting a passage, or in other words the diameter of the largest circle which can fit within the cross-section of this passage. When the passage in question has a circular cross-section, this exactly corresponds to the inside diameter of the passage.

The abovementioned fourth inscribed circle diameter is understood to mean the inscribed circle diameter for the inside surface of the wall delimiting the passage at the annular crease in the wringing position, in the absence of any solid object interfering with the narrowing of said annular crease. The concept of inscribed circle diameter is used here, because in some embodiments the brush and/or wringer and/or wand may have a non-circular cross-section.

In various embodiments of the wringer of the invention, one or more of the following arrangements may be used:

- the lower section converges towards a lower end which delimits said second inscribed circle diameter;
- the lower section has at least one lateral opening;
- the annular crease of the intermediate section has at least two lateral openings;
- the lateral openings of the annular crease each have a maximum width at the central throat;
- the third inscribed circle diameter is less than the first inscribed circle diameter;
- the lower section has an upper portion, adjacent to the intermediate section, which has an external width greater than the first inscribed circle diameter;
- the annular crease of the intermediate section comprises external protrusions on each side of the central throat, which press against one another in the wringing position;
- the wringer is injection molded as a single piece, of at least one synthetic material.

Another object of the invention is an applicator assembly designed for applying a product in the fluid state (a liquid or paste), comprising:

- a reservoir to contain said product, said reservoir comprising a neck,
- a wringer as defined above, its upper section being fixed in the neck of the reservoir,
- an applicator comprising a cap designed to be removably attached onto the neck of the reservoir, a wand extending from the cap through the wringer when said cap is mounted onto the neck, and an applicator head having a width that is greater than the second inscribed circle diameter and which is designed to, when it leaves the reservoir and passes through the wringer, exert on the lower section of the wringer an axial force sufficient to compress axially the annular crease of the intermediate section and place it in its wringing position.

In various embodiments of the applicator assembly of the invention, one or more of the following arrangements may be used:

- the wand has a diameter that is at most equal to the second inscribed circle diameter;
- the lower section of the wringer is sufficiently rigid not to fold over on itself when the applicator head exits the reservoir by passing through the lower section;
- the applicator assembly additionally comprises said product contained in the reservoir, said product being one chosen from among the following: a mascara, a lipstick, a foundation, an eye shadow, or a cosmetic care product.

A final object of the invention is a use of a container assembly as defined above, for care and/or makeup, particularly for eyelash care and/or makeup.

Other features and advantages of the invention will become apparent from the following description of one of its embodiments provided as a non-limiting example, with reference to the attached drawings.

BRIEF DESCRIPTION OF THE DRAWINGS

In the drawings.

In the various figures, the same references denote the same or similar elements.

DETAILED DESCRIPTION OF THE DISCLOSURE

Figure 1:
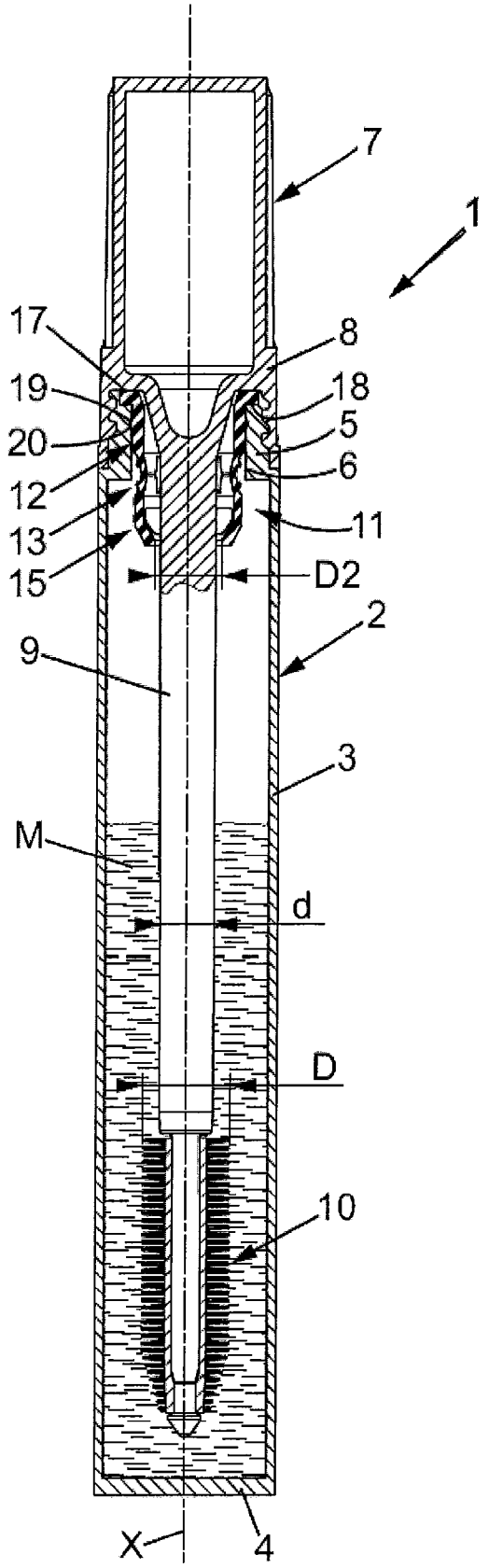
FIG. 1 is a longitudinal cross-sectional view of a mascara container assembly comprising a wringer according to an embodiment of the invention.

FIG. 1 represents a container assembly 1 for a fluid product (liquid or paste), particularly for a cosmetic product such as a mascara intended for eyelash makeup, this assembly 1 comprising:

- a reservoir 2 which comprises a lateral annular wall 3 extending axially, along a central axis X, between a bottom 4 and a neck 5, the neck 5 delimiting an inner central opening 6 which is substantially cylindrical, and
- an applicator 7.

The applicator 7 may for example comprise:

- a cap 8, made for example of plastic or metal material, screwed or attached in another removable manner to the neck 5,
- and a wand 9, made for example of plastic or metal and supported by the cap 8.

This wand 9 has a certain diameter d (diameter of the circle circumscribed in the cross-section of the wand if the wand is not cylindrical) and extends axially along the axis X inside the reservoir 2, down to a free end which has an applicator head 10, for example a brush made for example of a flexible synthetic material or other material, which is immersed in the mascara M contained in the reservoir 2. The applicator head 10 has a width D, and in particular an outside diameter D which is greater than d (D is the diameter of the circle circumscribed around the outside boundaries of the cross-section of the head 10 if the head is not cylindrical).

Figure 2:
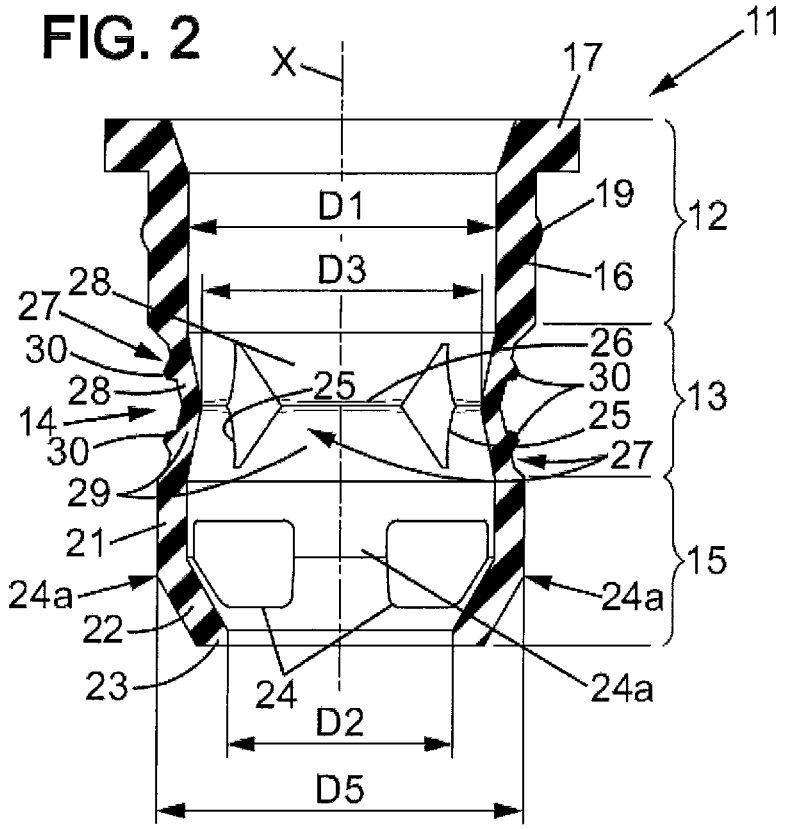
FIG. 2 is a detailed longitudinal cross-sectional view of the wringer of the container assembly in FIG. 1, with the wringer in the rest position.
Figure 3:
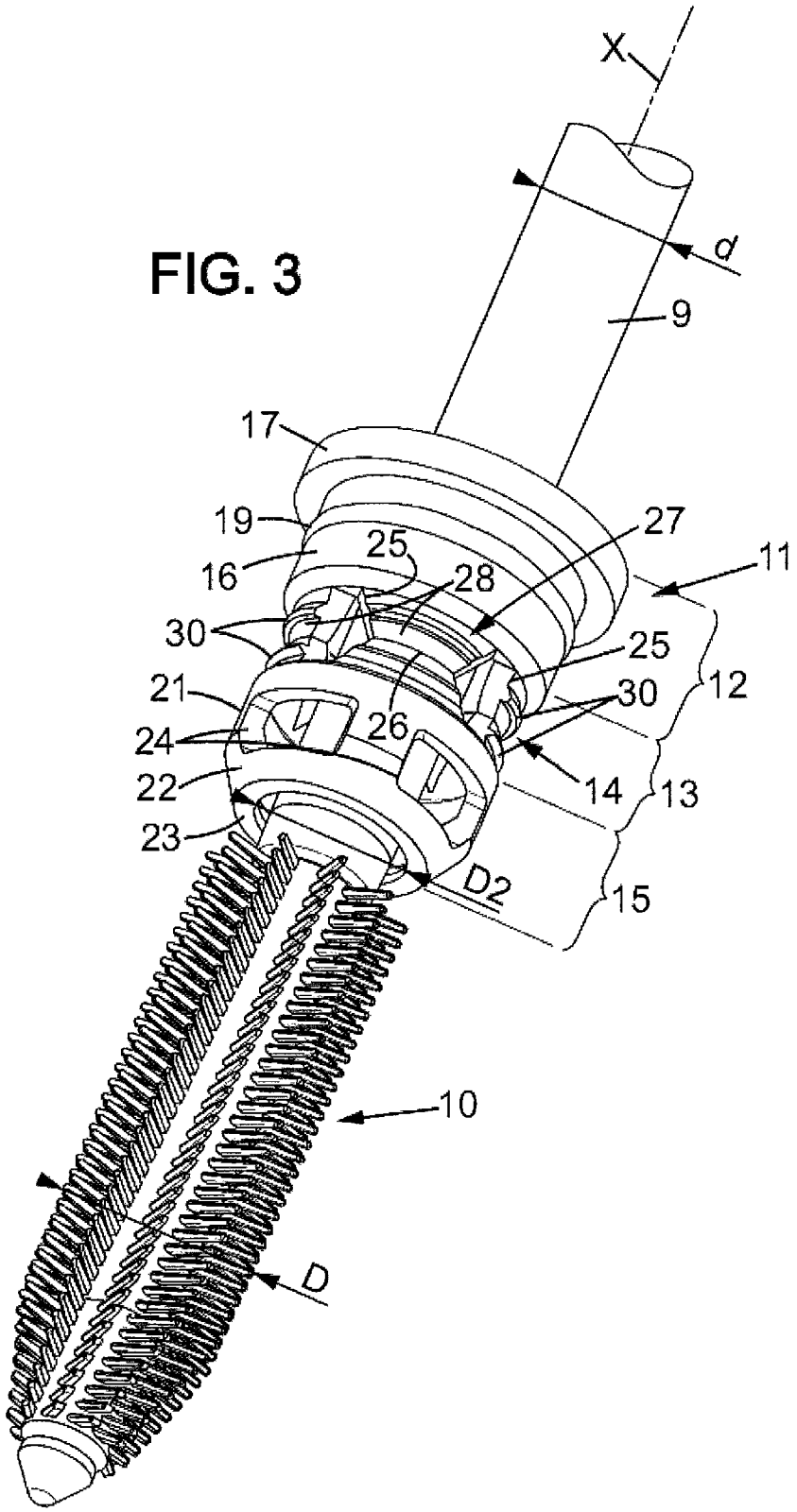
FIG. 3 is a perspective view showing the wringer of FIG. 2 as well as the wand and brush of the applicator of the container assembly of FIG. 1, with the wringer in the rest position.
Figure 4:
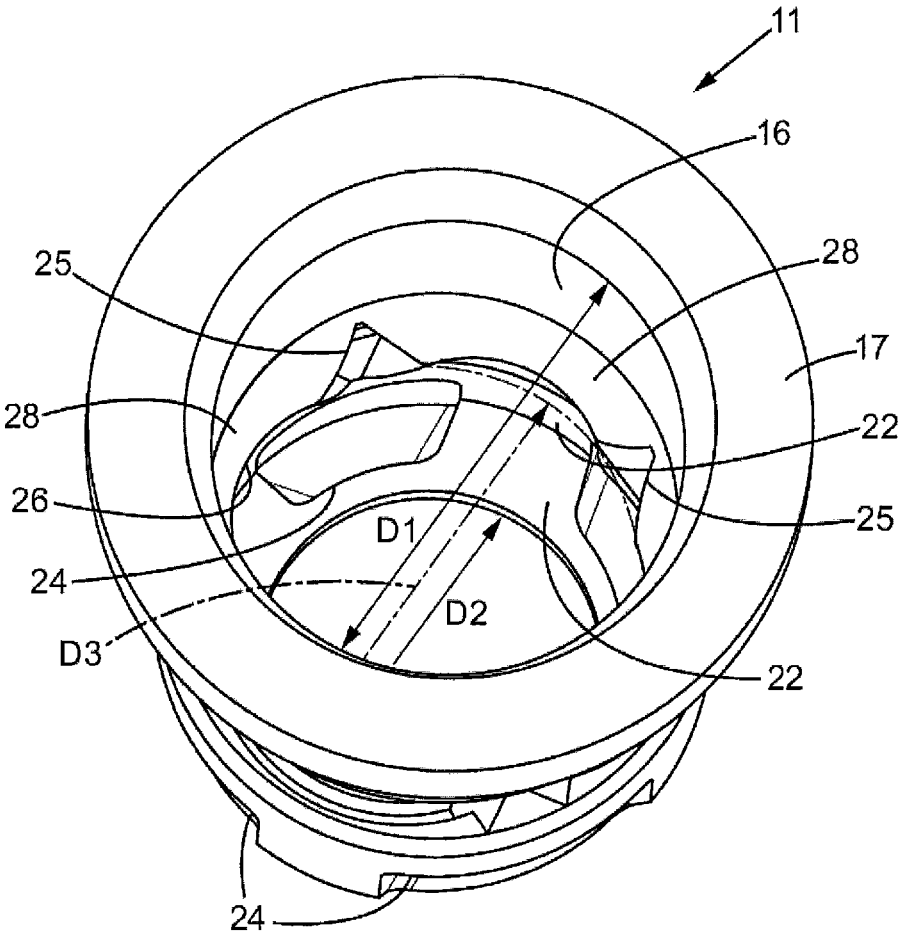
FIG. 4 is a three-quarter perspective view from above of the wringer of FIGS. 2 and 3 in the rest position.

As can be seen in FIGS. 2 to 4, the wringer 11 is in the form of an annular sleeve which is molded as a single piece of synthetic material and which extends axially along the axis X. The wringer 11 can be made for example by conventional techniques known to a person skilled in the art of injection molding, from one material or multiple materials. The synthetic material or materials constituting the wringer 11 can, for example, be chosen from the following: liquid silicones, polyolefins, polyamides, and their combinations. Examples of possible materials for the wringer comprise the following polymers: Styrene/Ethylene/Butadiene/Styrene or SEBS, polyethylene, Santoprene®, Hytrel®, Evoprene®. A particularly advantageous example of an embodiment using a single material is a SEBS of 45 Shore A hardness.

The wringer 11 comprises three successive sections:

- an upper section 12 which is designed to be secured by interlocking into the neck 5 of the reservoir,
- an intermediate section 13 which forms a single inwardly-projecting annular crease 14,
- and a free lower section 15 which extends into the reservoir 2.

As can be seen in FIGS. 1 and 2, the upper section 12 of the wringer can have a relatively thick cylindrical annular lateral wall 16 to give it a certain rigidity, enabling tight interlocking into the opening 6 of the neck 5. In addition, the upper portion of the lateral wall 16 can extend radially outwards as a collar 17 which can come into axial contact with the open end of the neck 5 of the reservoir, for example by fitting into a countersink 18 arranged in the open end of the neck 5.

It is possible for the central opening 6 of the neck 5 and the outer surface of the lateral wall 16 of the upper section 12 to comprise complementary protrusions and/or recesses which fit together by respective interlocking to more solidly attach the upper section 12 within the neck 5. For example, the lateral wall 16 of the upper section 12 can comprise an external annular rib 19 which fits into an annular crease 20 on the inside of the neck 5. There can also be studs on the external surface of the lateral wall 16, to contribute to the attachment of the upper section 12 to the neck 5 of the reservoir.

Figure 5:
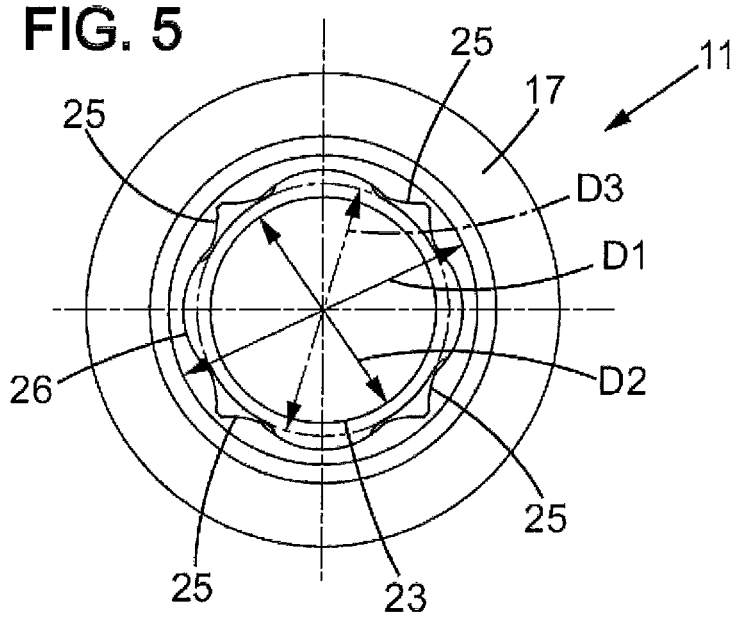
FIG. 5 is a top view of the wringer of FIGS. 2 to 4 in the rest position.

As represented in FIGS. 2, 4 and 5, the upper section 12 of the wringer delimits an inner passage forming a right circular cylinder around the axis X, having a first inside diameter D1. More generally, the inner passage delimited by the upper section 12 could have a shape which is not right-circular around the axis X, in which case the abovementioned first diameter D1 would be the inscribed circle diameter for said inner passage. The diameter D1 can, for example, be substantially equal to or slightly greater than the diameter D of the applicator head 10.

As can be seen in FIGS. 1, 2 and 3, the lower section 15 of the wringer extends into the volume inside the reservoir 2, preferably without contact with the neck 5 of said reservoir. The lower section 15 can comprise a cylindrical annular wall 21 centered around the axis X, which is extended into the reservoir 2 in a downwardly-converging wall 22 resembling a truncated cone. The inside diameter of the cylindrical wall 21 can for example be substantially equal to the aforementioned first diameter D1, and the outside diameter D5 of the cylindrical wall 21 (or more generally the width of the upper end of the lower section 15) is greater than the first diameter D1 such that the lower section 15 axially abuts against the upper section 12 when the two sections are moved towards one another by compressing the annular crease 14 of the intermediate section 13, as will be explained below.

The annular lower end 23 of the wall 22 resembling a truncated cone delimits a circular lower passage which has a second diameter D2 that is less than the first diameter D1. It is possible for the opening delimited by the lower end 23 not to be circular, in which case the second diameter D2 would be the inscribed circle diameter within this opening. The second diameter D2 substantially corresponds to the diameter d of the wand 9, or is very slightly greater than this diameter d, and said second diameter D2 is in all cases less than the diameter D of the applicator head 10. The ratio of D2/D is preferably between 0.3 and 0.9. The wringer of the invention has the advantage of being able to vary the wringing capacity over a wide range of values and in particular of having a greater wringing capacity when the ratio D2/D is lower. Thus a wringer of the invention provides a wringing capacity similar to that of "blade" type wringers, independently of the shape of the applicator head. A person skilled in the art can easily adapt the shape of the central throat (26) to the shape of the applicator head while achieving the desired wringing capacity. Note that the wringer of the invention is compatible with any type of wringable applicator head, no matter what the structure and type of material used, particularly for applying a product in the fluid state (liquid or paste) and more particularly a cosmetic care and/or makeup product such as a mascara, a lipstick, a foundation, an eye shadow, or a care product, particularly for around the eyes.

Advantageously, the lower section 15 of the wringer can comprise one or more lateral openings 24 which are distributed, preferably symmetrically, around the axis X. These lateral openings 24 are four in number in the example represented in the drawings.

These lateral openings 24 can be at least partially arranged in the cylindrical lateral wall 21 and advantageously can extend into the truncated-cone portion 22, approaching the open lower end 23 of the lower portion 15.

The lateral openings 24 can have a relatively large cross-section to facilitate the flow of mascara into the reservoir 2 during wringing, but between said lateral openings 24 there are solid portions 24*a* which form resistant columns connecting the upper end of the section 15 to its lower end 23 and ensuring the integrity of the shape of the lower section 15. For this purpose, the type of material of the lower section 15, the width of the columns 24*a*, the thickness of the wall of the lower section 15 (this thickness may possibly be less than the thickness of the aforementioned lateral wall 16, but is preferably greater than the thickness of the intermediate wall 13) are such that the lower section 15 does not fold back upon itself in the upward direction when the applicator head exits the reservoir 2.

The intermediate portion 13 comprises at least two lateral openings 25 symmetrically distributed around the axis X, as represented in FIGS. 2 to 5. These openings 25 may also be distributed in an asymmetrical manner around the axis X. Said openings 25 may also have different shapes. In the example represented, these lateral openings 25 are four in number and are substantially lozenge-shaped. More generally, said lateral openings 25 each have a maximum horizontal width at the level of the central throat 26 of the annular crease 14 and grow narrower in the upward and downward directions, for example substantially along the entire height of the intermediate section 13. The shape of the openings 25 preferably comprises a maximum width at the central throat 26 in order to facilitate the deformation of the annular crease 14 when moving from the rest position to the wringing position.

Thus the distribution of the openings 25 and the shape of each opening 25 guide the deformation of the intermediate section 13 at the annular crease 14 to obtain a central throat of the desired form, such as for example a circle in the example represented. There is no limitation on the shape. A regular polygon is preferred, however, such as a square, rectangle, lozenge, or triangle.

These lateral openings 25 are separated from each other by vertical arms 27 which each connect the lower end of the lateral wall 16 of the upper section 12 to the upper end of the cylindrical wall 21 of the lower section 15. Each of these vertical arms 27 comprises first and second portions 28, 29 converging inwardly and towards the central throat 26, respectively from the lower end of the lateral wall 16 of the upper section and from the upper end of the cylindrical wall 21 of the lower section 15.

The set of four vertical arms 27 substantially forms a converging/diverging system of walls, the set of first portions of arms 27 forming a wall that is substantially a downwardly-converging truncated-cone shape, and the set of second portions 29 of arms 27 forming a wall that is substantially an upwardly-converging truncated-cone shape.

As can be seen in FIGS. 2 and 3, the first and second portions 28, 29 of each arm 27 comprise external annular ribs 30 which are symmetrically arranged relative to the central throat 26 and which are thus adapted to abut against one another when the central crease 14 is compressed by bringing the upper section 12 and the lower section 15 closer together, as will be explained below. The return of the wringer to the rest position occurs automatically when the brush is no longer in the wringer.

In the rest position of the wringer, the central throat 26 of the annular crease 14 delimits a central passage which here has a nearly circular cross-section and which has a third inscribed circle diameter D3. The third inscribed circle diameter D3 is greater than the second inscribed diameter D2 and is generally slightly less than the first inscribed circle diameter D1.

The intermediate section 13 of the wringer has a thickness which is generally less than the upper section 12 and the lower section 15, facilitating an inward bending of the arms 27 when the upper 12 and lower 15 sections are brought axially closer together. For the same purpose, when the wringer 11 is made of multiple synthetic materials, it is possible for the intermediate section 13 to be made of a more flexible material than the upper section 12 and lower section 15.

The container assembly just described functions as follows.

Figure 6:
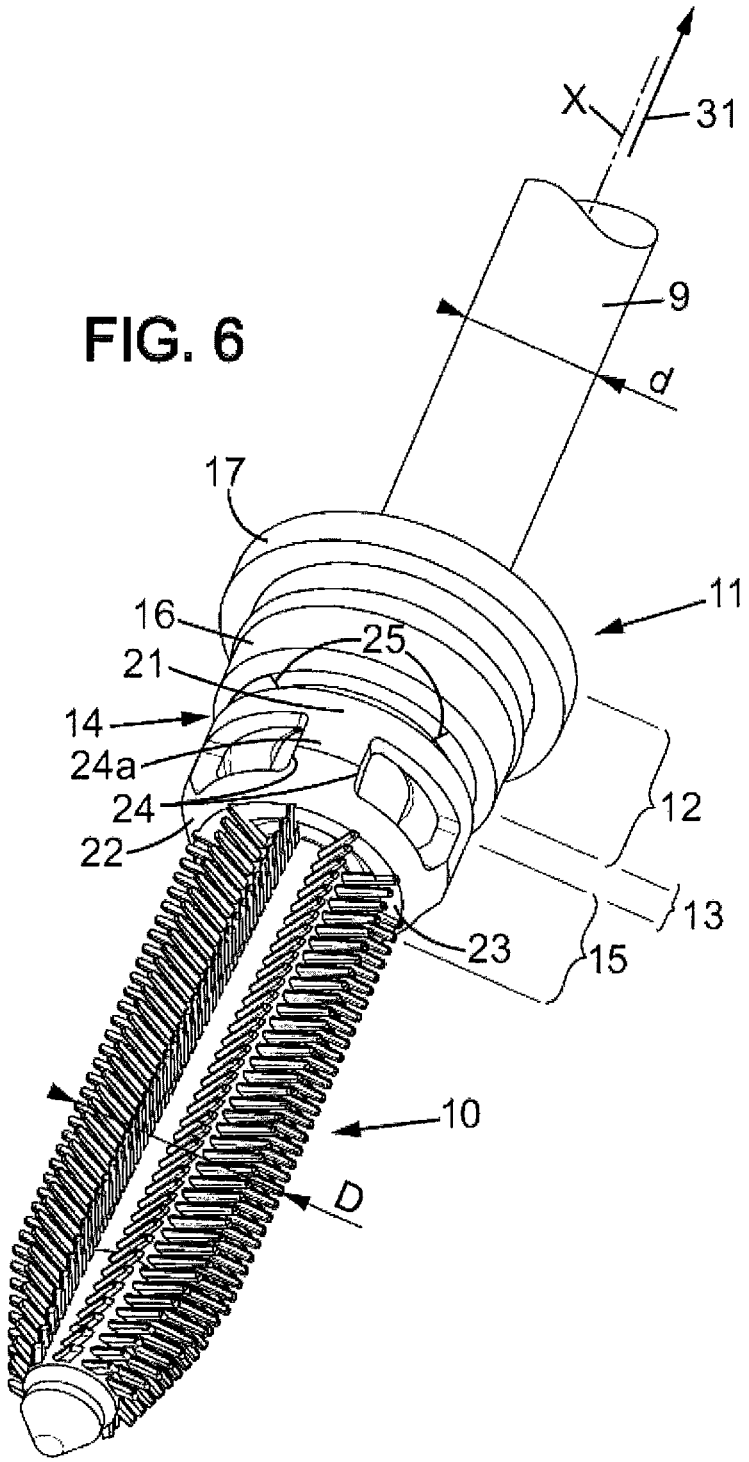
FIG. 6 is a view similar to FIG. 3, showing the wringer in the wringing position as the brush exits the reservoir of the container assembly.
Figure 7:
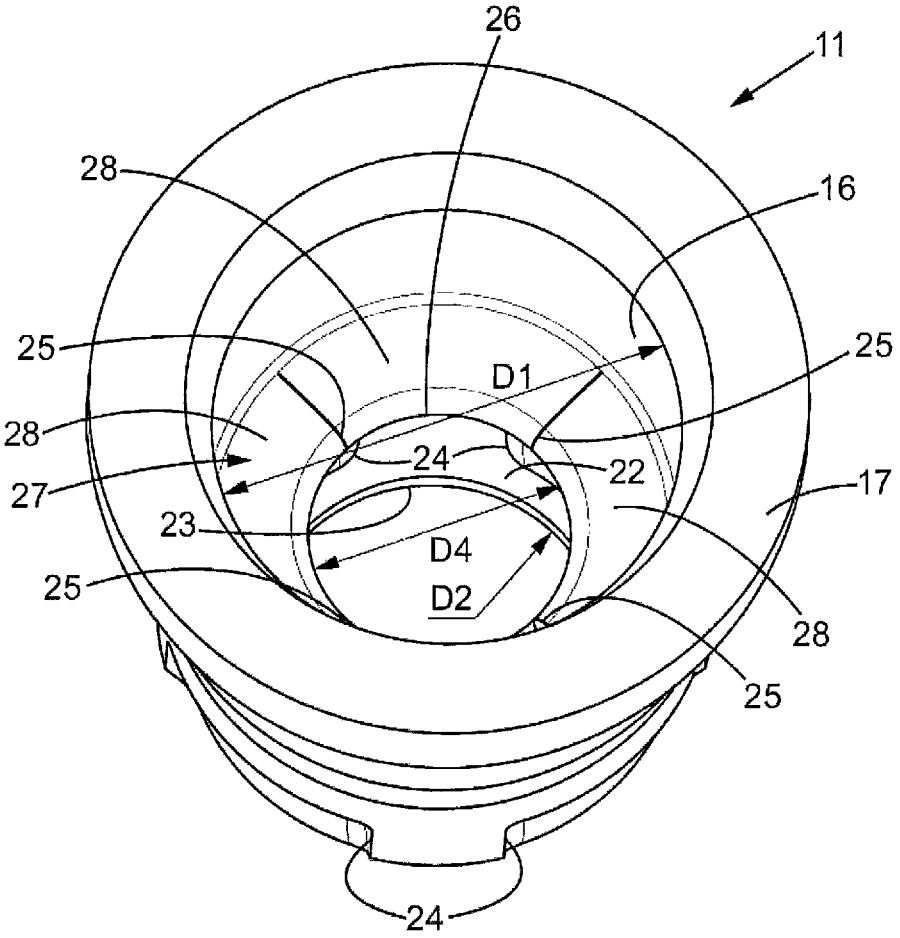
FIG. 7 is a view similar to FIG. 4, showing the wringer in the wringing position.
Figure 8:
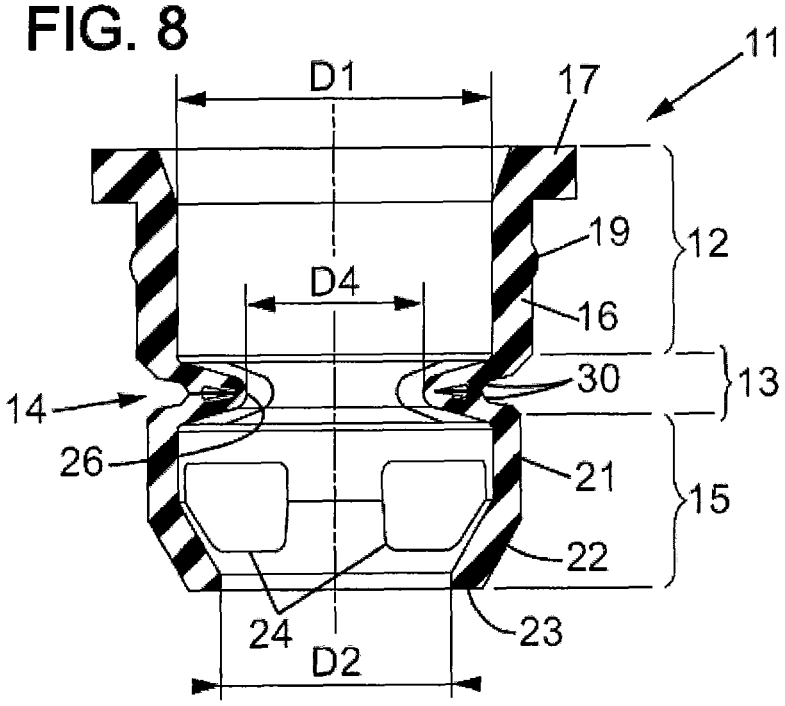
FIG. 8 is a longitudinal cross-sectional view similar to FIG. 2, showing the wringer in the wringing position.
Figure 9:
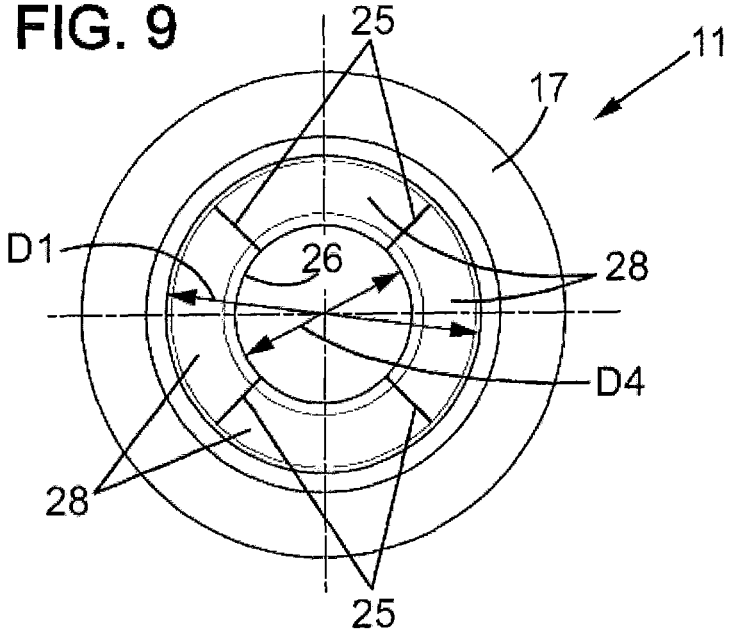
FIG. 9 is a top view of the wringer in the wringing position.

When a user wishes to apply mascara M onto her eyelashes, she withdraws the applicator head 10 from the reservoir 2 through the wringer 11, in the direction of the arrow 31 represented in FIG. 6.

During this movement, when the bristles or nubs of the applicator head 10 pass through the lower end 23 of the lower section, bending as they traverse it, they push the lower section 15 upwards and compress the annular crease 14 of the intermediate section 13, thus placing the wringer 11 in a wringing position which is clearly visible in FIGS. 6 to 9.

In this wringing position, the axial compression of the annular crease 14 further narrows the central throat 26 of this annular crease, and closes the lateral openings 25 of this annular crease. The central throat 26 then has a fourth inscribed circle diameter D4 which is less than the abovementioned second inscribed circle diameter D2. The shape of the central throat 26 can be substantially circular in the rest position and in the wringing position, as in the example represented in the drawings, but this shape may also be non-circular, for example substantially polygonal and in particular substantially square in shape when the annular crease 14 comprises four openings 25 arranged 90° apart from each other as in the example considered here. In general, the cross-section of the annular crease 14 can be identical to the cross-section of the applicator head or it can be different (for example, the applicator head 10 can be substantially cylindrical with a circular cross-section and the annular crease 14 can have a substantially square cross-section).

In the free state, meaning when the sections 12, 15 of the wringer are moved closer together axially in the absence of the wand 9, the fourth diameter D4 can be substantially equal to the diameter d of the wand 9, but can also be less than the diameter d by several tenths of a millimeter (for example by 1 to 2 millimeters less), such that the central throat 26 scrapes the applicator head 10 and removes the excess mascara as the applicator head exits. The excess mascara scraped in this manner flows downward from the annular crease 14 and reenters the reservoir 2 through the openings 24 in the lower section 15 and the open lower end 23 of said section 15.

During this phase, the lower section 15 retains the integrity of its form as explained above, without folding back on itself in the upward direction, and this lower section 15 is also prevented from rising inside the upper section 12 by axial translation, due to the upper end of said lower section 15 coming up against the lower end of the upper section 12 and due to the ribs 30 or other protrusions acting as stops on the annular crease 14 coming into contact with one another and contributing to maintaining the annular crease 14 in a radial plane.

After the applicator head 10 exits, the wringer 11 returns to its rest position due to elasticity, and when the user has finished using the applicator 7, she returns it into the reservoir 2 by inserting the applicator head 10 back through the wringer 11 and into the reservoir. As the applicator head 10 reenters, it biases the lower section 23 towards the inside of the reservoir, such that the annular crease 14 of the intermediate section substantially maintains its rest position where said annular crease is not very pronounced. Under these conditions, the applicator head 10 is exposed to almost no wringing as it passes through the wringer 11 and into the reservoir, and in addition, the shape of the wringer 11 at rest allows said applicator head 10 to contribute to cleaning the inside surface of the wringer as it reenters the reservoir. These arrangements prevent the mascara from remaining in the neck or in the wringer and solidifying there. Thus the wringer of the invention avoids the various clogging phenomena and also maintains consistent wringing throughout the entire life of the product.

The invention claimed is:

1. A wringer in the form of an annular sleeve wherein the wringer which comprises:

an upper section designed to be secured by interlocking into the neck of a reservoir of product, said upper section having a first inscribed circle diameter, a free lower section having a second inscribed circle diameter that is less than the first inscribed circle diameter, an intermediate section which forms an inwardly projecting annular crease delimiting a central throat having a third inscribed circle diameter which is greater than the second inscribed circle diameter in a rest position, and said annular crease being deformable, by axial compression between the upper and lower sections, to a wringing position in which said central throat is smaller than in the rest position, said central throat having in said wringing position a fourth inscribed circle diameter which is less than the second and third inscribed circle diameters, and wherein there is only one annular crease.

2. The wringer according to claim 1, wherein the lower section converges towards a lower end which delimits said second inscribed circle diameter.

3. The wringer according to claim 1, wherein the lower section has at least one lateral opening.

4. The wringer according to any claim 1, wherein the annular crease of the intermediate section has at least two lateral openings.

5. The wringer according to claim 4, wherein the lateral openings of the annular crease each have a maximum width at the central throat.

6. The wringer according to claim 1, wherein the third inscribed circle diameter is less than the first inscribed circle diameter.

7. The wringer according to claim 1, wherein the lower section has an upper portion, adjacent to the intermediate section, which has an external width greater than the first inscribed circle diameter.

8. The wringer according to claim 1, wherein the annular crease of the intermediate section comprises external protrusions on each side of the central throat, which abut against one another in the wringing position.

9. The wringer according to claim 1, injection molded as a single piece, of at least one synthetic material.

10. An applicator assembly for applying a product in the fluid state, wherein the applicator assembly comprises:

a reservoir to contain said product, said reservoir comprising a neck, a wringer according to claim 1, in which the upper section is fixed in the neck of the reservoir, an applicator comprising a cap designed to be removably attached onto the neck of the reservoir, a wand extending from the cap through the wringer when said cap is mounted onto the neck, and an applicator head having a width that is greater than the second inscribed circle diameter and which is designed to, when it leaves the reservoir and passes through the wringer, exert on the lower section of the wringer an axial force sufficient to compress axially the annular crease of the intermediate section and place it in its wringing position.

11. The assembly according to claim 10, wherein the wand has a diameter that is at most equal to the second inscribed circle diameter.

12. The assembly according to claim 10, additionally comprising said product contained in the reservoir, said product being chosen from among the following: a mascara, a lipstick, a foundation, an eye shadow, or a cosmetic care product.

* * * * *